United States Patent [19]

Serrano

[11] 4,162,551

[45] Jul. 31, 1979

[54] FOOTBRIDGE FOR CONNECTION BETWEEN A FIXED INSTALLATION AND AN OSCILLATING INSTALLATION

[75] Inventor: Francisco de Assis Manuel Serrano, Issy-les-Moulineaux, France

[73] Assignee: Compagnie Generale pour les Developpements Operationnels des Richesses Sous-Marines, Paris, France

[21] Appl. No.: 890,510

[22] Filed: Mar. 27, 1978

[30] Foreign Application Priority Data

Mar. 25, 1977 [FR] France ..... 77 09084

[51] Int. Cl.[2] ..... E01D 1/00

[52] U.S. Cl. ..... 14/69.5; 14/71.1

[58] Field of Search ..... 14/69.5, 71.1, 72.5; 61/48

[56] References Cited

U.S. PATENT DOCUMENTS

| | | | |
|---|---|---|---|
| 233,159 | 10/1880 | Mooney | 14/69.5 |
| 1,593,999 | 7/1926 | Bingham | 14/71.1 X |
| 2,372,574 | 3/1945 | Haynes | 14/71.1 |
| 2,478,177 | 8/1949 | Beutel | 14/71.1 |
| 2,617,131 | 11/1952 | Harris | 14/71.1 |
| 2,641,785 | 6/1953 | Pitts | 14/71.1 |
| 2,803,841 | 8/1957 | Wellens | 14/71.1 |
| 3,426,719 | 2/1969 | Mizell | 14/71.1 X |
| 4,003,473 | 1/1977 | Ryan | 14/71.1 |
| 4,011,615 | 3/1977 | Maxson | 14/71.1 |
| 4,035,861 | 7/1977 | Edge | 14/72.5 X |

*Primary Examiner*—Nile C. Byers, Jr.

*Attorney, Agent, or Firm*—Armstrong, Nikaido, Marmelstein & Kubovcik

[57] ABSTRACT

A footbridge for connection between a fixed installation and an oscillating installation, for example petroleum production platforms, comprising three sections hinged together, the end sections being hinged to rotatable platforms adapted to be secured to the decks of the installations and the platform secured to the oscillating installation being secured thereto by a ball joint. Apparatus is also provided for compensating for the weight of the footbridge, the apparatus consisting of counterweights or jacks mounted on at least one of the installations.

6 Claims, 2 Drawing Figures

FOOTBRIDGE FOR CONNECTION BETWEEN A FIXED INSTALLATION AND AN OSCILLATING INSTALLATION

BACKGROUND OF THE INVENTION

1. Field of the Invention

This invention relates to a footbridge for connection between a fixed installation and an oscillating installation particularly suitable for connecting rigid and oscillating petroleum exploitation platforms situated a short distance from each other.

2. Description of the Prior Art

Footbridges are known, more particularly for connecting, for example, a quay to the bridge of a ship. Generally, these footbridges are fixed, either to the bridge of the ship or to the quay, and are maintained a short distance above the quay or the bridge in a manner to permit an oscillatory movement of the ship in relation to the quay. These oscillations are always of small amplitude.

The problem is however much more complicated when oscillations of large amplitude are concerned, with rapid changes of direction. This is the case for example with exploitation platforms at sea and more particularly in the case of an assembly of fixed and oscillating platforms. For easily comprehensible safety reasons, the simple solution applicable between a ship at anchor in a port and a quay can no longer be considered on account of the amplitude of the oscillations and their frequent change in direction, especially in heavy weather.

SUMMARY OF THE INVENTION

The object of the invention is to provide a footbridge the two ends of which are secured to the decks of the connected installations.

According to the invention, a footbridge for connection between a fixed installation and an oscillating installation is characterised in that it consists of three sections hinged together, the two end sections being hinged to rotating platforms fixed to the decks of the installations, the platform fixed to the oscillating installation being held by a ball joint.

Means for compensating the weight of the footbridge may be provided on at least one of the installations. They consist of a counterweight device or jacks.

The upper surface of the platform is level with the surface of the deck. Coupling members connect the platforms to the deck in which they are embedded.

BRIEF DESCRIPTION OF THE DRAWINGS

The description and drawings given hereinafter by way of example, will enable the method of carrying the invention into effect to be well understood.

DETAILED DESCRIPTION OF THE PREFERRED EMBODIMENTS

Figure 1:
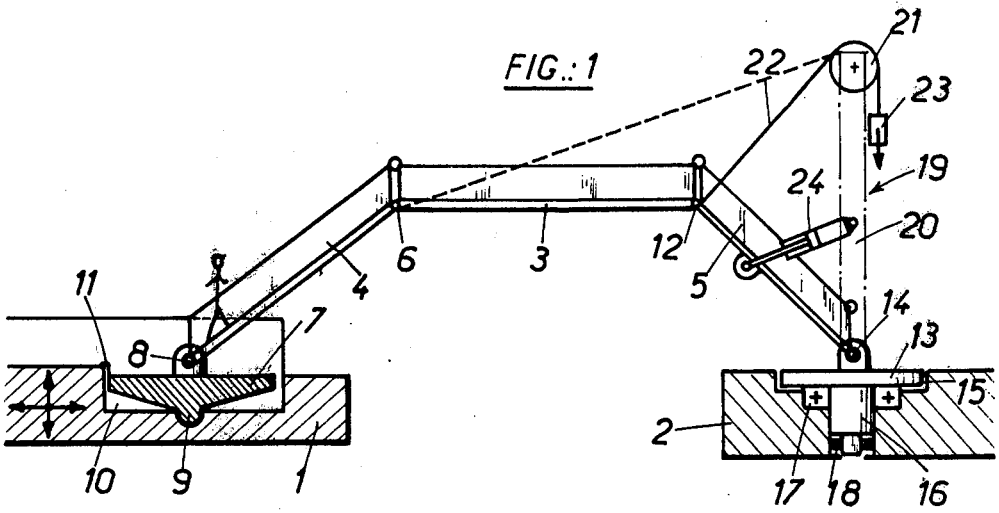
FIG. 1 is a diagrammatic sectional view of a footbridge according to the invention.
Figure 2:
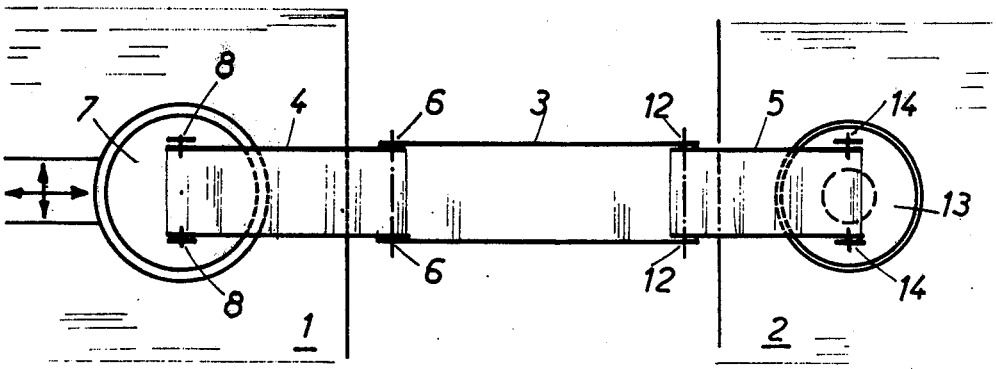
FIG. 2 is a plan view of the footbridge of FIG. 1.

FIGS. 1 and 2 show an embodiment of a footbridge according to the invention. This footbridge connects the decks of two installations, installation 1 being oscillating and installation 2 fixed. These installations are, for example, petroleum research or production platforms.

The oscillating platform consists, for example, of a column carrying the bridge 1 and resting by way of a ball joint on a base which secures it to the sea bed. This platform, because of its method of connection and its design is subjected to oscillations of limited amplitude but capable of occurring in any direction. The displacement of the deck of the platform is greater and more frequent the worse the state of the sea. On the contrary, the fixed platform 2, consisting of a column or pillars fixed to a submarine base, and therefore forms a rigid assembly unaffected by the state of the sea. It often happens that production, which has started from a fixed platform, requires an extension which, for reasons of cost and speed of construction, is realised by an oscillating platform.

In such a case, it is necessary to ensure a permanent and workable connection, whatever the weather, between the two platforms. This necessity and the characteristic of at least one of the installations calls for the use of a footbridge capable of satisfying strict safety criteria.

According to the embodiment illustrated, the footbridge consists of three sections: a central section 3 and two end sections 4 and 5. The end section 4 is connected at one end to the central section 3 by a hinge 6 and at the other end to a platform 7 by a hinge 8.

This platform is provided on its lower surface with a ball joint 9. The platform 7 is located in a housing 10 on the oscillating deck 1 in such manner that its upper surface is substantially level with the deck.

Coupling members 11, secured between the edges of the platform and the deck, avoid any risk of accident when the platform oscillates in its housing and a pedestrian wishes to cross the space betwen the platform and the deck. These coupling members consist of flexible bands or of bellows.

The section 5 of the footbridge is connected at one end to the end of the section 3 by a hinge 12 and at the other end to a rotatable platform 13 by a hinge 14. The platform 13 is held in a housing 15 on the deck and is provided on its lower surface with an axle 16 turning in roller bearings 17 and 18.

In order to reduce the forces borne by the axle and ball joint, the weight of the footbridge is borne by at least one counterweight device 19 consisting, in known manner, of a mast 20 supporting at its end a pulley 21 over which is passed a cable 22 secured at one end to a section of the footbridge and at the other end to a counterweight 23. In order to avoid instability, the footbridge is sustained by two such systems.

According to an alternative, a jack 24 is provided between the mast 20 and the section 5 of the footbridge. This jack, hinged to a section of the footbridge, is used by itself or in combination with the counterweight device 19.

The compensating devices are fixed either to the platforms or to the deck.

According to another embodiment, a second counterweight devices (shown in chain lines in FIG. 1) holds the other end of the central section 3 of the footbridge. The weight of the footbridge is thus balanced and the ball joint 9, thus the platfrom 7, no longer has to compensate the horizontal component of the pressure exerted by the section 3 on the section 4.

According to different embodiments of the ball joint known per se, the latter may be a free ball joint or a resilient return ball joint. In the case of a free ball joint, the spherical cap turns freely in the spherical housing; while in the case of a resilient return ball joint, a device limits the oscillatory movements. A resilient return ball joint is particularly suitable for counterbalancing the reaction caused by the section 3, for example, when the latter is not sustained by a counterweight device.

Steps provided on the sections 4 and 5 are mounted at an acute angle, on the order of 80°, to the vertical risers; and thus, the slope of the step is about 10°, as illustrated in FIG. 1. This arrangement seeks to avoid the steps sloping downwardly when there are oscillations of the installation and movement of the footbridge and causing the feet to slip. The feet are thus always wedged against the risers whether ascending or descending.

I claim:

1. A footbridge for connection between a fixed installation and an oscillating installation, said installations having decks, said footbridge comprising three sections consisting of a central section and two end sections hinged to respective ends of said central section, said central section being maintained at an upper level with respect to the level of the decks of said fixed and oscillating installations, rotatable platforms adapted to be secured to said decks, the ends of said end sections not secured to said central section being hinged respectively to said rotatable platforms, said rotatable platform adapted to be secured to the deck of said oscillating installation being provided with one member of a ball joint adapted for engagement with the other member of said ball joint to be located on said deck, the upper surface of said platforms being substantially level with the upper surface of said decks, and means for compensating for the weight of said footbridge.

2. A combination according to claim 1, wherein said compensating means are secured to said rotatable platforms.

3. A footbridge according to claim 1, comprising means for coupling the rotatable platform to be located on the oscillating installation to the deck of said installation.

4. A footbridge according to claim 3, wherein said coupling means is a bellows.

5. A footbridge according to claim 1, wherein said end sections are provided with steps comprising treads and risers, said treads being disposed at an acute angle to said risers.

6. A footbridge according to claim 5 in which said acute angle is of the order of 80°.

* * * * *